US011776513B2

(12) United States Patent
Martinez Orts

(10) Patent No.: US 11,776,513 B2
(45) Date of Patent: Oct. 3, 2023

(54) BOW FOR A BOWED STRING MUSICAL INSTRUMENT

(71) Applicant: Constantino Martinez Orts, Valencia (ES)

(72) Inventor: Constantino Martinez Orts, Valencia (ES)

( * ) Notice: Subject to any disclaimer, the term of this patent is extended or adjusted under 35 U.S.C. 154(b) by 296 days.

(21) Appl. No.: 16/977,480

(22) PCT Filed: Feb. 28, 2019

(86) PCT No.: PCT/ES2019/070121
§ 371 (c)(1),
(2) Date: Sep. 2, 2021

(87) PCT Pub. No.: WO2019/166683
PCT Pub. Date: Sep. 6, 2019

(65) Prior Publication Data

US 2022/0180845 A1 Jun. 9, 2022

(30) Foreign Application Priority Data

Mar. 2, 2018 (ES) ..... ES201830279U

(51) Int. Cl.
*G10D 3/16* (2020.01)

(52) U.S. Cl.
CPC ..... *G10D 3/16* (2013.01)

(58) Field of Classification Search
CPC ..... G10D 3/16; G10D 3/00
See application file for complete search history.

(56) References Cited

U.S. PATENT DOCUMENTS 10,210,847 B1 * 2/2019 Leslie ..... F21V 33/0056
2019/0392797 A1 * 12/2019 Bossert ..... F21V 33/0056

FOREIGN PATENT DOCUMENTS

TW M532636 11/2016
WO WO 2009/143071 11/2009

OTHER PUBLICATIONS

Informe de Busqueda Internacional y Opinion Escrita [International Search Report and the Written Opinion] dated Jun. 11, 2019 From the International Searching Authority Re. Application No. PCT/ES2019/070121 and its Translation of Search Report Into Enghsh. (14 Pages).
Bithead "Violin Bow Lightsaber", Bithead's Blog, Wordpress, 7 P., Jan. 21, 2017.
Motion Exposure "Violin With LED Light Bow", Motion Exposure, YouTube Video, Sep. 10, 2016.

* cited by examiner

*Primary Examiner* — Kimberly R Lockett

(57) ABSTRACT

The invention relates to a bow for a bowed string musical instrument, which comprises a narrow stick and one or more strips or hairs for rubbing the strings of a bowed string musical instrument. The bow incorporates at least one illuminating means, a processing means able to activate and control the illuminating means, and a power supply battery for the electrical power supply of the illuminating means, all said elements being disposed on the narrow stick.

11 Claims, 1 Drawing Sheet

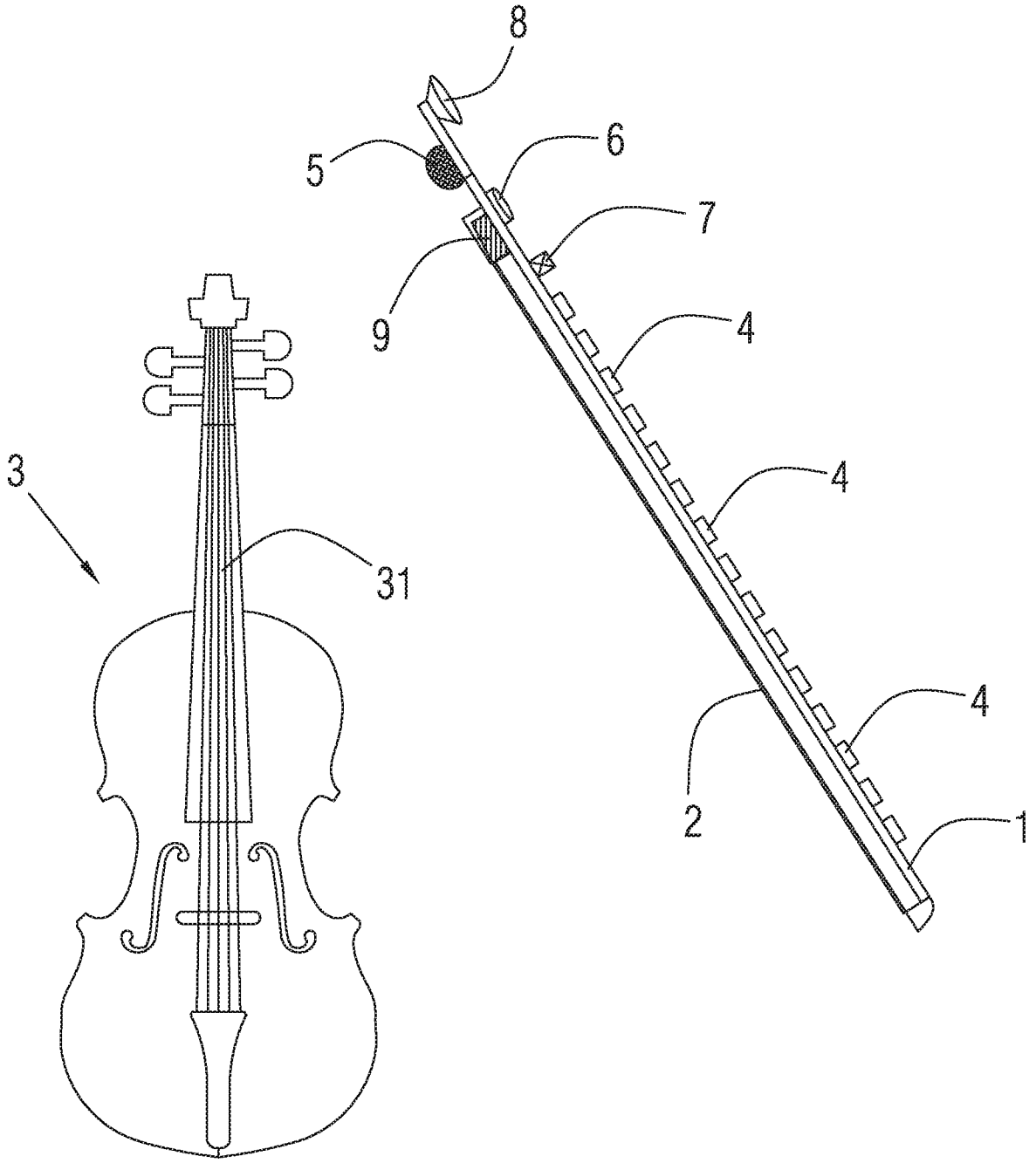
8
5
6
7
9
4
4
3
31
4
2
1

BOW FOR A BOWED STRING MUSICAL INSTRUMENT

RELATED APPLICATIONS

This application is a National Phase of PCT Patent Application No. PCT/ES2019/070121 having International filing date of Feb. 28, 2019, which claims the benefit of priority of Spanish Patent Application No. U201830279 filed on Mar. 2, 2018. The contents of the above applications are all incorporated by reference as if fully set forth herein in their entirety.

FIELD AND BACKGROUND OF THE INVENTION

The object of the present invention application is the registration of a bow for a bowed string musical instrument, which incorporates notable innovations and advantages over the techniques used until now.

More specifically, the invention proposes the development of a bow for a bowed string musical instrument, which, due to the particular arrangement thereof, enables illuminating properties that are recreationally useful and also adapted to the entertainment industry to be provided for a bow of the kind already known for use in a bowed string musical instrument, such as a violin.

In the current state of the art, bowed string musical instruments are known, such as the violin, also known because they use a bow for rubbing on the strings of the instrument itself for the operation thereof.

The use of said musical instruments is likely to require some type of properties added to the musical properties thereof which are already known.

The present invention contributes to solving and resolving the present problem, since it enables illuminating properties that are recreationally useful and also adapted to the entertainment industry to be provided for a bow of the kind already known for use in a bowed string musical instrument.

SUMMARY OF THE INVENTION

The present invention has been developed in order to provide a bow for a bowed string musical instrument, which comprises a narrow stick and one or more strips or hairs for rubbing the strings of a bowed string musical instrument, essentially characterised in that it incorporates at least one illuminating means, a processing means able to activate and control the illuminating means, and a power supply battery for the electrical power supply of the illuminating means, all said elements being disposed on the narrow stick.

Alternatively, the bow for a bowed string musical instrument incorporates a switch with manual actuation disposed on the narrow rod and interposed between the illuminating means and the power supply battery, and which is able to permanently turn the illuminating means on or off as desired by the user and is able to inhibit the actuation of the processing means on the illuminating means.

Preferably, in the bow for a bowed string musical instrument, each illuminating means comprises an LED.

Preferably, in the bow for a string musical instrument, the processing means comprises a microprocessor.

Alternatively, in the bow for a bowed string musical instrument, the processing means are able to activate and control the illuminating means following a repetitive sequence previously programmed in the processing means itself.

Alternatively, the bow for a bowed string musical instrument incorporates a sound recording means and at the same time linked in data communication with the processing means, and the processing means being able to activate and control the illuminating means according to the data received from the sound recording means.

Alternatively, the bow for a bowed string musical instrument incorporates a tension recording means physically linked to the strips or hairs and at the same time linked in data communication with the processing means, and the processing means being able to activate and control the illuminating means according to the data received from the tension recording means.

Additionally, in the bow for a bowed string musical instrument, the processing means have Wi-Fi or Bluetooth communication capacity or similar, enabling them to be controlled and programmed remotely and simultaneously to the use thereof.

Preferably, in the bow for a bowed string musical instrument, the bowed string musical instrument is a violin.

Alternatively, in the bow for a bowed string musical instrument, the bowed string musical instrument is a cello.

Alternatively, in the bow for a bowed string musical instrument, the bowed string musical instrument is a viola.

Alternatively, in the bow for a bowed string musical instrument, the bowed string musical instrument is a double bass.

Thanks to the present invention, it is possible for a bow of the kind already known for use in a bowed string musical instrument, for example a violin, to be provided with illuminating properties that are recreationally useful and also adapted to the entertainment industry.

Other features and advantages of the bow for a bowed string musical instrument will be evident in light of the description of a preferred, but not exclusive, embodiment, which is illustrated by way of a non-limiting example in the drawings which are attached, in which:

BRIEF DESCRIPTION OF THE SEVERAL VIEWS OF THE DRAWINGS

FIG. 1 is a schematic view of a preferred embodiment of the bow for a bowed string musical instrument of the present invention.

DESCRIPTION OF SPECIFIC EMBODIMENTS OF THE INVENTION

As shown schematically in FIG. 1, the bow for a bowed string musical instrument of the proposed invention comprises a narrow rod 1 and one or several strips 2 or hairs for rubbing on the strings 31 of the same musical instrument 3, in the manner already known in the state of the art.

In this preferred embodiment represented in FIG. 1, the bowed string musical instrument 3 is a violin. In other preferred embodiments not represented in FIG. 1, the bowed string musical instrument 3 can be a cello, a viola, or a double bass, for example, or any other known in the state of the art.

Already according to the invention itself, the bow for a bowed string musical instrument of the present invention incorporates at least one illuminating means disposed on the narrow rod 1, a processing means able to activate and control said illuminating means, and a power supply battery 6 enabled to power the illuminating means.

In this preferred embodiment, it involves a plurality of illuminating means, each illuminating means being an LED 4, and the processing means comprises a microprocessor 5.

Both the LEDs 4 and the microprocessor 5, as well as the power supply battery 6, are disposed on the narrow rod 1, and such that they do not alter the dynamic equilibrium of the bow for a bowed string musical instrument of the invention during use when rubbing the strings 31 of the musical instrument 3.

The power supply battery 6 is rechargeable, for example by means of a USB connector.

The bow for a bowed string musical instrument of the invention can also incorporate a switch 7 with manual actuation disposed on the narrow rod 1 and interposed between the LEDs 4 and the power supply battery 6, and therefore able to turn the LEDs 4 on or off.

Said switch 7 with manual actuation is interleaved between the LEDs 4 and the power supply battery 6, such that the LEDs 4 can stay invariably on or off as desired by the user, and are able to inhibit the actuation of the microprocessor 5 on the LEDs 4.

The microprocessor 5 is able to activate and control the LEDs 4. This activation and control of turning the LEDs 4 on and off is carried out according to a programming incorporated in the microprocessor 5 itself.

The LEDs 4 used also have the possibility of changing the colour of the emitted light, according to the control thereof from the microprocessor 5 programmed to this end.

The microprocessor 5 is programmable, and it can also have Wi-Fi or Bluetooth communication capacity or similar, enabling them to be programmed and controlled remotely and simultaneously to the use of the bow for a bowed string musical instrument of the proposed invention. Therefore, the programming used by the microprocessor 5 and the consequent result obtained in turning the LEDs 4 on and off can be altered remotely, even during the very use of the bow for a bowed string musical instrument of the invention.

In this sense, turning the LEDs 4 on and off can follow a certain rhythmic and repetitive sequence previously programmed in the microprocessor 5 itself.

In another preferred embodiment, according to another programming, the microprocessor 5 is able to activate and control the LEDs 4 following the sound rhythm of the surrounding musical melody, generated by the bowed string musical instrument 3 itself or by the entire orchestra wherein it is integrated, for example. To do so, the bow for a bowed string musical instrument of the proposed invention incorporates a sound recording means 8 and at the same time linked in data communication with the microprocessor 5. According to the surrounding musical melody recorded by the sound recording means 8 and the representative data communicated by the same to the microprocessor 5, the same microprocessor 5 activates and controls turning the LEDs 4 on and off, with an on and off sequence in accordance with the sound rhythm of the surrounding musical melody.

In another preferred embodiment, the microprocessor 5 is able to activate and control the LEDs 4 according to the intensity of pressure exerted by the strips 2 or hairs on the bowed strings 31 of the musical instrument 3. To do so, the bow for a bowed string musical instrument of the proposed invention incorporates a tension recording means 9 physically linked to the strips 2 or hairs, and at the same time linked in data communication with the microprocessor 5. According to the tension recorded by the tension recording means 9 in the strips 2 or hairs and the representative data communicated by the same to the microprocessor 5, the same microprocessor 5 activates and controls turning the LEDs 4 on and off, with an on and off sequence according to the pressure exerted by the strips 2 or hairs on the bowed strings 31 of the musical instrument 3.

The bow for a bowed string musical instrument of the proposed invention, in the different preferred embodiments thereof, maintains a dynamic equilibrium during use when rubbing the strings 31 of the musical instrument 3.

The connection cables between the different elements described stay hidden from view, in order to thus maintain the aesthetics of the bow for a bowed string musical instrument of the invention.

The details, shapes, dimensions and other secondary elements, as well as the materials used in manufacturing the bow for a bowed string musical instrument of the invention, may be suitably replaced with others that are technically equivalent and do not depart from the essential nature of the invention or from the scope defined by the claims included below.

What is claimed is:

1. A bow for a bowed string musical instrument, which comprises:

a narrow stick (1) and one or more strips (2) or hairs for rubbing the strings (31) of a bowed string musical instrument (3), at least one illuminating means, a processing means able to activate and control the illuminating means, a power supply battery (6) for the electrical power supply of the illuminating means, all said elements being disposed on the narrow stick (1), and a switch (7) with manual actuation disposed on the narrow rod (1), and interposed between the illuminating means and the power supply battery (6), and which is able to permanently turn the illuminating means on or off as desired by the user and is able to inhibit the actuation of the processing means on the illuminating means.

2. The bow for a bowed string musical instrument according to claim 1, wherein each illuminating means comprises an LED (4).

3. A bow for a bowed string musical instrument, which comprises:

a narrow stick (1) and one or more strips (2) or hairs for rubbing the strings (31) of a bowed string musical instrument (3), at least one illuminating means, a processing means able to activate and control the illuminating means, and a power supply battery (6) for the electrical power supply of the illuminating means, all said elements being disposed on the narrow stick (1); wherein the processing means comprises a microprocessor (5).

4. The bow for a bowed string musical instrument according to claim 1, wherein the processing means is adapted to activate and control the illuminating means following a repetitive sequence previously programmed in the processing means.

5. The bow for a bowed string musical instrument according to claim 1, further comprising a sound recording means (8) and at the same time linked in data communication with the processing means; wherein the processing means is adapted to activate and control the illuminating means according to the data received from the sound recording means (8).

6. The bow for a bowed string musical instrument according to claim 1, further comprising a tension recording means (9) physically linked with the strips (2) or hairs and at the same time linked in data communication with the processing means; wherein the processing means is adapted to activate and control the illuminating means according to the data received from the tension recording means.

7. A bow for a bowed string musical instrument, which comprises:

a narrow stick (1) and one or more strips (2) or hairs for rubbing the strings (31) of a bowed string musical instrument (3), at least one illuminating means, a processing means able to activate and control the illuminating means, and a power supply battery (6) for the electrical power supply of the illuminating means, all said elements being disposed on the narrow stick (1):

wherein the processing means have Wi-Fi or Bluetooth communication capacity or similar, enabling them to be controlled and programmed remotely and simultaneously to the use thereof.

8. The bow for a bowed string musical instrument according to claim 1, wherein the bowed string musical instrument (3) is a violin.

9. The bow for a bowed string musical instrument according to claim 1, wherein the bowed string musical instrument (3) is a cello.

10. The bow for a bowed string musical instrument according to claim 1, wherein the bowed string musical instrument (3) is a viola.

11. The bow for a bowed string musical instrument according to claim 1, wherein the bowed string musical instrument (3) is a double bass.

* * * * *